United States Patent [19]

Sundberg

[11] Patent Number: 4,492,560

[45] Date of Patent: Jan. 8, 1985

[54] GAS COMBUSTION CONTROL APPARATUS

[76] Inventor: Hardy Sundberg, R.R. #1, Brantford, Ontario, Canada, N3T 5L4

[21] Appl. No.: 551,751

[22] Filed: Nov. 14, 1983

[51] Int. Cl.[3] ..... F23N 5/00

[52] U.S. Cl. ..... 431/12; 431/20; 431/76; 431/90; 236/15 E

[58] Field of Search ..... 431/12, 20, 76, 89, 431/90; 236/15 E

[56] References Cited

U.S. PATENT DOCUMENTS 2,532,214 11/1950 Willenborg ..... 431/76

3,288,199 11/1966 Gerrard et al. ..... 431/76

*Primary Examiner*—Carroll B. Dority, Jr.

*Attorney, Agent, or Firm*—Hirons, Rogers & Scott

[57] ABSTRACT

Apparatus for controlling the combustion of natural gas in a natural gas fired appliance is described. Exhaust gases are sampled and maintained at a predetermined constant temperature between the dew point and the steam point. The relative humity of the constant temperature gas is monitored by a hygrometer. Relative humidity deviations from a predetermined value result in output signals from the hygrometer to a control circuit. The control circuit is connected to regulators in the air intake or chimney of the appliance which regulate air intake to keep the relative humidity substantially constant and hence control combustion of the gas. In another embodiment the relative humidity of the exhaust gases and the combustion air intake are monitored by separate hygrometers which are linked to each other so that a change in the relative humidity of a gas affecting one hygrometer will compensate the other hygrometer and control combustion as before. The latter arrangement is useful when the relative humidity of the combustion intake air is very high as occurs in hot, humid summer weather.

21 Claims, 6 Drawing Figures

GAS COMBUSTION CONTROL APPARATUS

The present invention relates to gas combustion control apparatus and particularly, but not exclusively, to apparatus for controlling the combustion of gas in a natural gas fired appliance or furnace.

A large percentage of natural gas appliances or furnaces have no controls that monitor the efficiency of combustion. The reason for this is that a 5% to 20% savings in the amount of fuel consumed is small as compared to the capital expenditure of such a combustion control system. Therefore, the payback cannot be justified. Some existing gas combustion control equipment involves carefully regulating the quantity of oxygen or carbon dioxide using gas regulators, but these are expensive and are only really suitable for use with very large industrial furnaces where the saving over a prolonged period may justify the capital expenditure on this type of equipment.

An object of the present invention is to obviate or mitigate the above-said disadvantages.

According to the present invention there is provided apparatus for controlling the combustion of a fuel in an appliance comprising:

means for receiving the exhaust gases of the appliance, means for maintaining the exhaust gases at a substantially constant temperature between the steam point and the dew point of the gases, humidity sensor means for monitoring the relative humidity of the substantially constant temperature exhaust gases and for producing an output signal corresponding to the relative humidity deviating from a predetermined level, and control means for using said output signal to control the combustion of fuel in the appliance to retain the humidity to said predetermined level.

According to the present invention there is further provided a method of controlling the combustion of fuel in an appliance comprising the steps of, sampling the combustion exhaust gases from the appliance, and maintaining the temperature of the exhaust gases at a substantially constant value between the steam point and the dew point, monitoring the relative humidity of said substantially constant temperature gas, and providing an output signal corresponding to the monitored relative humidity deviating from a predetermined value, and using said output signal to control the combustion of fuel to maintain complete combustion at the predetermined level.

According to yet a further aspect of the present invention there is provided apparatus for compensating for additional water vapour in high humidity combustion intake air comprising a first humidity sensor adapted to receive combustion exhaust gases, a second humidity sensor adapted to receive intake air, the first and second humidity sensors being separated from contact with the intake air and the exhaust gases respectively, linkage means connected between the first and second sensors such that in response to excess water vapour in the intake air, movement of said first sensor in response to said excess water vapour in the exhaust gases is compensated by the same amount of movement of said second sensor in response to said water vapour in the intake air, and by the linkage means this cancels the effect of excess water vapour in the intake air so that said first sensor remains responsive to substantially only the water in the combustion exhaust gases.

The embodiments of the present invention will now be described by way of example, with reference to the accompanying drawings in which.

Figure 1:
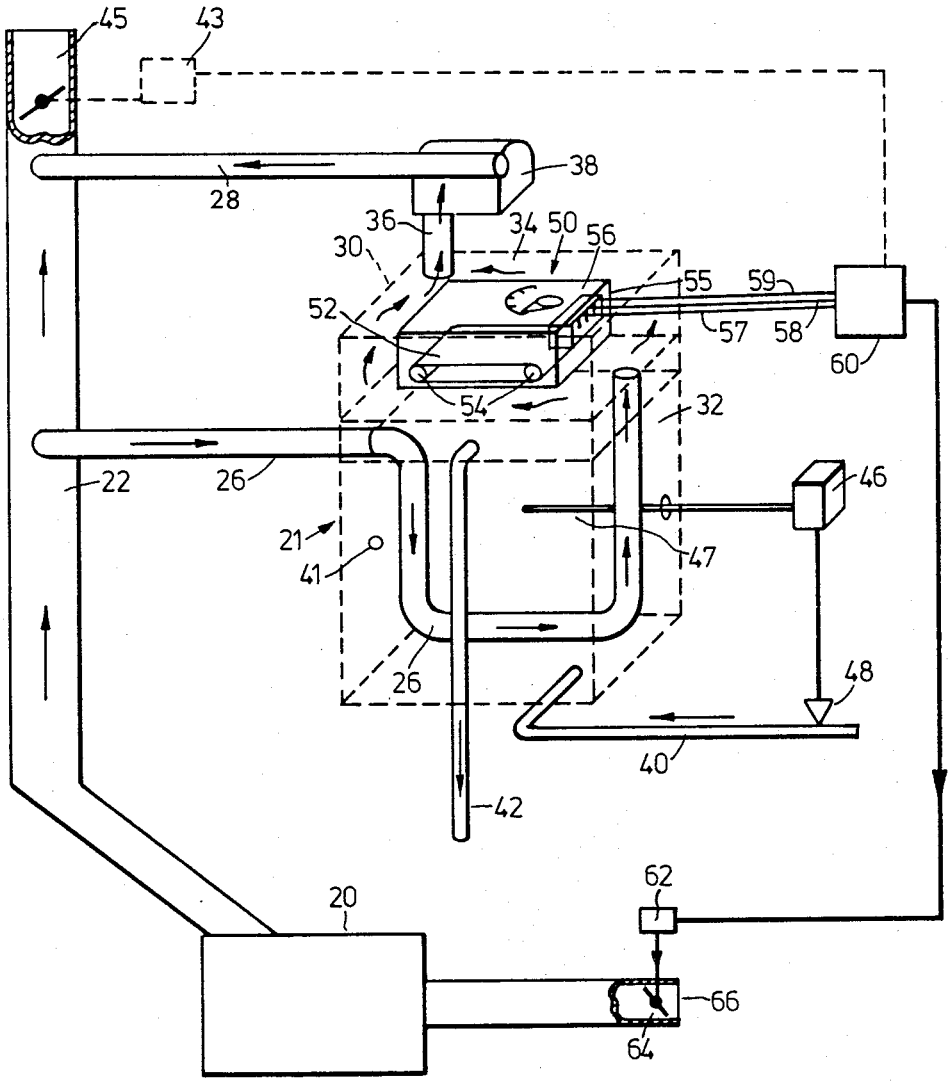
FIG. 1 is a schematic diagram of one embodiment of the combustion control apparatus used to monitor the relative humidity of the exhaust gases from a furnace.
Figure 5:
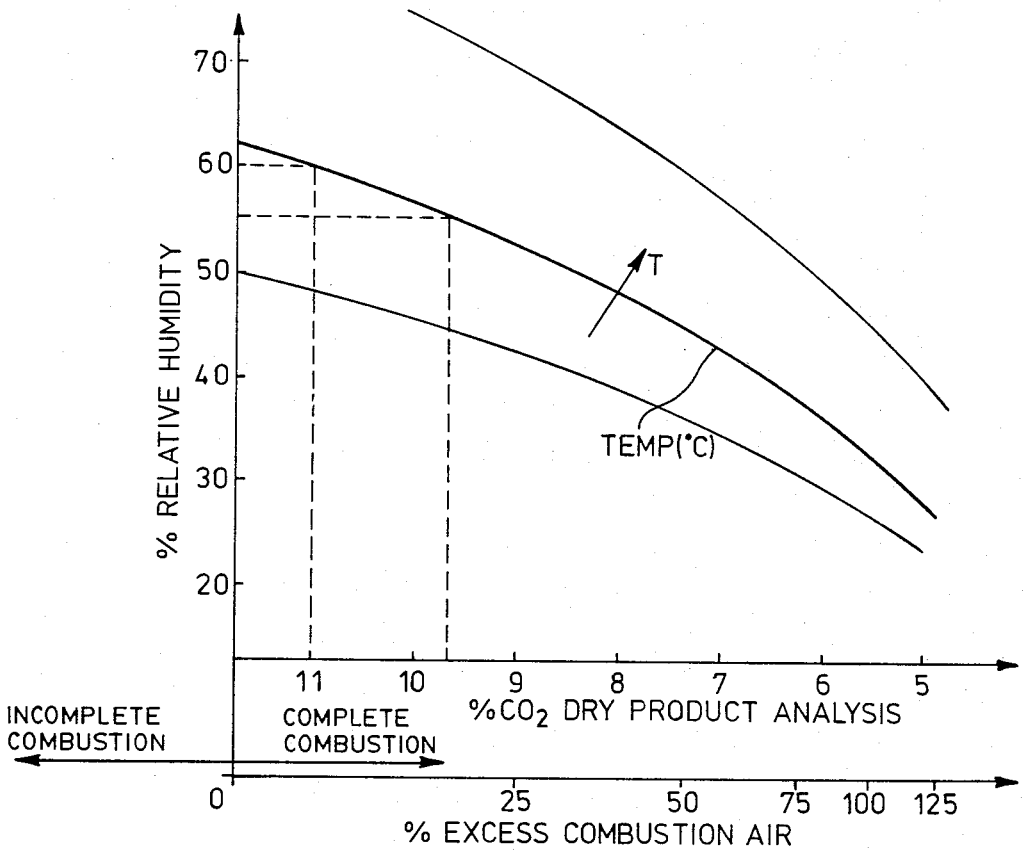
FIG. 5 is a graph showing the relationship between relative humidity and carbon dioxide concentration in combustion product gases for a given relative constant temperature value.
Figure 6:
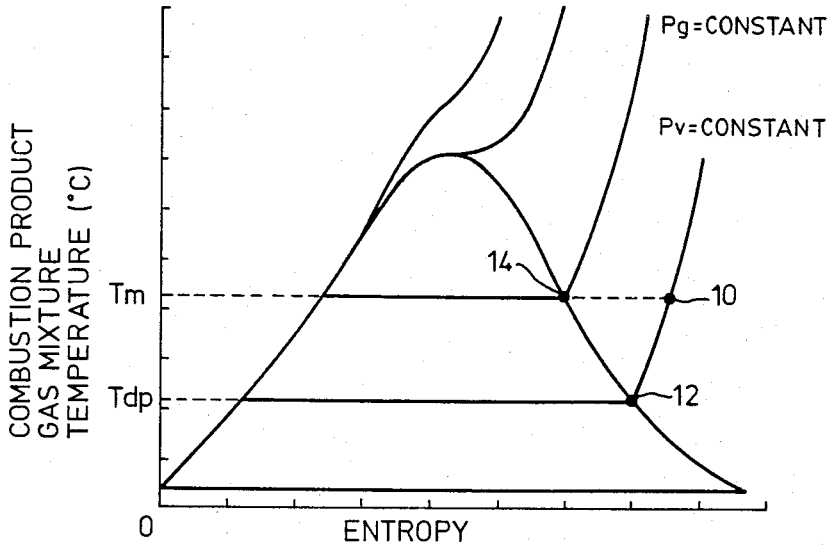
FIG. 6 is a typical temperature-entropy diagram for steam.

Referring now to FIG. 1 of the drawings, a natural gas-fired furnace 20 with a chimney 22 has a combustion control apparatus 24 connected thereto by an inlet pipe 26 and an outlet pipe 28 respectively. Exhaust gases from the furnace are first maintained at a constant temperature and the relative humidity of the exhaust gases is then monitored by the apparatus 24 to control the supply of surplus air to optimise combustion for the natural gas as will be described in more detail later. However, in order to best explain and provide a clear background for the invention a review of the theory will be presented with reference to FIGS. 5 and 6. FIG. 5 is a graph showing the relationship between relative humidity and carbon dioxide concentration in combustion product gases for a given relative constant temperature value above the dew point (D.P.) and below the steam point (S.P.). From the graph shown in FIG. 5 it will be seen that the relative humidity of the gas increases as the carbon dioxide increases for a particular value of temperature. A temperature of 70° Celsius (°C.) gives a different graph than 60° C. or 80° C. (Celsius). This curve is used, as will be described later to optimise the combustion of natural gas in the furnace 20. FIG. 6 is a typical graph of temperature versus entropy for steam, such as is well known in the art. A detailed explanation of the temperature-entropy diagram is beyond the scope of the invention but is considered to be common knowledge to one skilled in the art. Constant pressure lines $P_v$ and $P_g$ are shown and constant temperature lines $T_m$ and $T_{dp}$.

The relative humidity, $\phi$, of a gas is defined as a ratio of the partial pressure of the vapour $P_v$ in a mixture to the saturation pressure of the vapour, $P_g$, at the same temperature and pressure of the mixture and may be expressed as $$\phi = P_v/P_g \quad (1)$$

In a first state denoted by reference 10, the temperature of the mixture is $T_m$ and the partial pressure of the vapour is $P_v$. At the second state denoted by numeral 12, the dew point (D.P.) temperature is, $T_{dp}$, and the partial pressure of the vapour remains $P_v$. At the third state, denoted by reference numeral 14, the temperature of the mixture is $T_m$ and the saturation pressure of the vapour at $T_m$ is $P_g$.

The humidity ratio, W, describes the quantity of water vapour in the mixture mass, $m_v$, in terms of the mass of dry products present, mp, this ratio being expressed as:

$$W = m_v/m_p \quad (2)$$

The specific volume $\nu$ of a gas is expressed $\nu = V/m$, where V is the total volume and m is the total mass.

The humidity ratio W may then be expressed as:

$$W = V/\nu v/V/\nu p = \nu p/\nu v \quad (3)$$

Now, using the general ideal gas equation, $$P\nu = R_u T/M \quad (4)$$

where $R_u$ is a universal gas contant and M is the molecular weight of the gas of the weight of the gas, the humidity ratio can be expressed as $$W = \frac{\nu_p}{\nu_v} = \frac{R_u T/P_p M_p}{R_u T/P_v M_v} \quad (5)$$

$$= \frac{M_v P_v}{M_p P_p} \quad (6)$$

For water, the molecular weight is 18.02 and the molecular weight of the dry gases in the exhaust depends upon the products. For good combustion the percentage of $CO_2$ in the exhaust gas may be 11% at T=70° C. with a 60% relative humidity.

The formula of natural gas combustion with air may be expressed as $$\text{Natural Gas} + \text{Air} = 1\ CO_2 + 2H_2O + 7.97\ N_2 + 0.12O_2 \quad (7)$$

$$Mp = \frac{N_{N2}(M_{N2}) + N_{CO2}(M_{CO2}) + N_{O2}(M_{O2})}{N_{N2} + N_{CO2} + N_{O2}} \quad (8)$$

where $N_i$ is the number of moles of the ith component.

$$M_p = 29.82 \text{ for } CO_2 = 11\%$$

Therefore $$W = \frac{18.02}{29.82} \frac{P_v}{P_p}$$

$$W = 0.604 \frac{P_v}{P_p} \cdot \frac{P_g}{P_g} \quad (1)$$

$$\frac{P}{P_g} = \frac{W P_p}{0.604 P_g} \quad (9)$$

The relative humidity, $\phi$, can be expressed by the following equation.

$$\phi = WP_p/0.604\ P_g \quad (9)$$

This indicates that there are three variables which can alter the relative humidity $\phi$. These variables are the humidity ratio W, the partial pressure of the dry gas products $P_p$ and the saturation pressure of the vapour $P_g$ at mixture temperature.

Assuming that the combustion products are the same and that the total pressure and the temperature of the products are constant, then $$\phi = FW \quad (10)$$

where F is some constant. Therefore the relative humidity, $\phi$, is only dependent on the amount of water vapour present. Therefore holding $\phi$ constant would ensure a continuously good combustion because this would ensure that the percentage $CO_2$ is constant using the relationship of FIG. 5.

Referring now to FIG. 1 of the drawings in more detail the natural gas-fired furnace 20 has a chimney 22 to which the exhaust gases from the combustion of the natural gas are vented. A combustion control apparatus, generally indicated by reference numeral 24, is connected to the chimney 22 by an inlet pipe 26 and an outlet pipe 28, respectively. The combustion control apparatus 24 comprises a housing 30 which has a lower water chamber 32, and an upper gas chamber 34. The gas chamber 34 is connected by a fan intake tube 36 connected to a fan 38 which in turn is connected by the outlet pipe 28 to the chimney 22. The water chamber 32 is fed with cooling water via an inlet pipe 40 connected to the lower portion of the chamber 32 and an overflow 42 is provided in the upper end of the chamber 32. The temperature of water 41 in the chamber 32 is monitored by means of a thermostat 46 which has a temperature probe or thermistor 47 located in the water. The thermostat 46 is connected to an electrically-operated valve 48 located in the cooling pipe 40 to regulate the flow of cooling water to the interior of the water chamber to maintain the temperature of the water 41 substantially constant.

Figure 3:
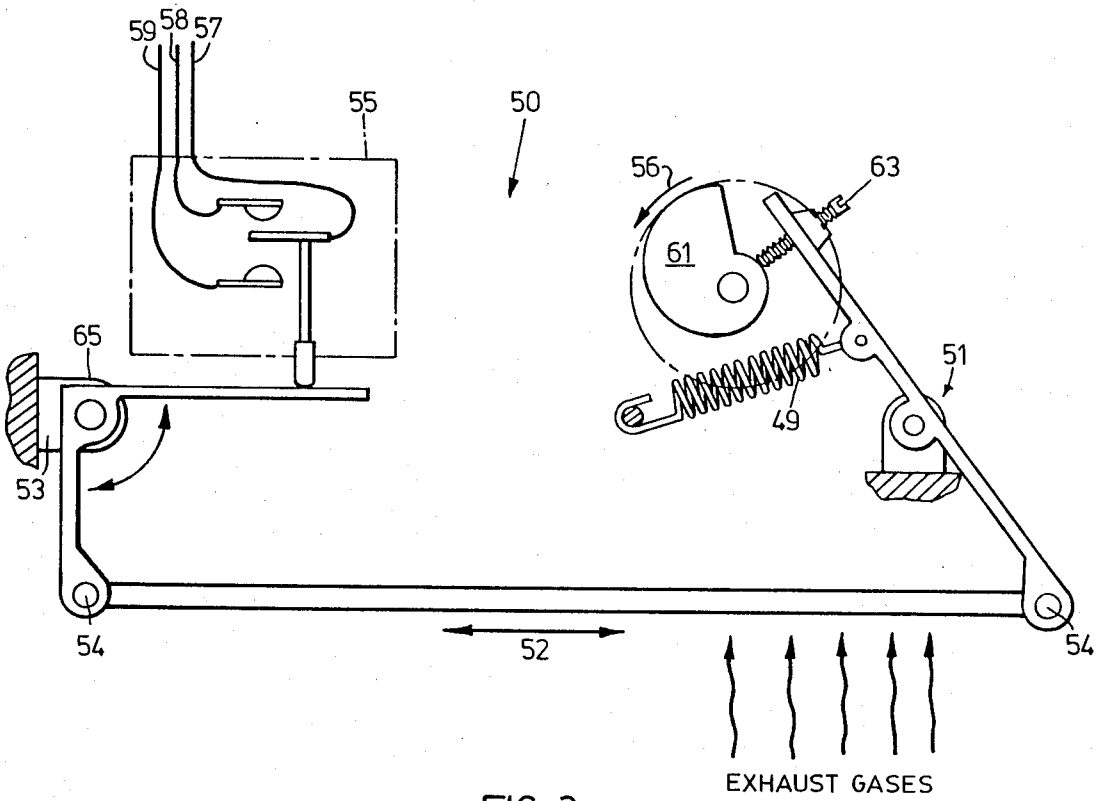
FIG. 3 is a more detailed diagram of the humidity sensor shown in FIG. 1.

As best shown in FIG. 3 the gas chamber 34 contains a relative humidity sensor (RANCO, Type J10, RANCO, U.S.A.) or hygrommeter which is generally denoted by reference numeral 50. The relative humidity sensitive diaphragm 52 is mounted on spaced supports 54 which are movable in the plane of the diaphragm as they are coupled to pivotally mounted control arms 51 and 53. Control arm 53 has a movable contact 57 mounted thereon which is movable between an upper switch contact 57 and a lower switch contact 59. The diaphragm 52 has a dial 56 associated with it and adjustment of this dial 56 varies the angle of control arm 51 by means of a cam 61 axially connected to the dial 56. A fine adjustment screw 63 abuts the cam and permits initial adjustment to ensure that the relative humidity setting on the dial 56 corresponds to the sensed humidity that holds the contact 58 between the contacts 57, 59. A tension spring 49 fixes the position of control arm 51 by pulling it against the cam 61 so that rotation of the dial acts through cam 61 to set the position of spaced support 54. The length of the diaphragm 52, which varies with humidity changes dictates the position of the other spaced support 54 and through the control arm 53, the position of contact 58 to which it is attached. Therefore, the three contacts 57, 58 and 59 provide electrical output signal from the humidity sensors 50 in response to the movement of the diaphragm 52. When the humidity is above the preset value on the dial 56, the diaphragm 52 relaxes and the control arm 53 pivots downwardly and the movable contact 57 contacts the contact 59. When the humidity is below the preset value the diaphragm tightens and the control arm pivots upwardly so that contacts 57 and 58 engage. The leads are connected to a control circuit 60, the output of which is connected to a motor 62 which operates a damper 64 at the combustion air intake 66 of the furnace 20. The control circuit 60 is of a type standard in the art.

The operation of the apparatus shown in FIG. 1 is as follows: Exhaust gases from the combustion of the natural gas in the furnace enter chimney 22. A sample of the exhaust gas is drawn off by a constant negative pressure created in the gas chamber 34 by the circulation induced by fan 38. The path taken by the sample of the exhaust gas (in the direction of the arrows) is through the intake tube 26 which passes through the water chamber 32 and into the gas chamber 34 where it circulates, through the fan inlet tube 36 to be advanced by the circulation fan 38 through the outlet tube 28 and back into the chimney 22. The exhaust gas sample is cooled by the substantially constant temperature of the water 41 from about 160°-200° Celsius (°C.) at the inlet pipe 26 to about 70° Celsius (°C.) in the gas chamber 34 such that it is above the Dew point (D.P.) and below the steam point (S.P.). When the cooling water 41 becomes too warm the thermister 47 actuates thermostat 46 to operate valve 48 and admit cold water into the water chamber. The surplus warm water in the water chamber 32 is allowed to run off through the overflow drain pipe 40.

A desired level of relative humidity, o, for example 60% corresponding to a high $CO_2$ level indicating almost stoiceometric combustion is selected by adjusting the dial 56 to adjust the spacing between supports 54 to place a specific tension on the diaphragm 52. A change in relative humidity alters moisture uptake by the diaphragm and hence causes it to change length which alters tension in the diaphragm 52 and hence the position of the movable contacts. This change in length causes the contacts on the switch 55 to close corresponding to high or low relative humidity. When the humidity is high a contact is made between switch contacts 57 and 59 and an electrical signal is transferred from the common wire 57 to wire 59. This signal then passes to a control circuit 60 which controls the motor 62 to actuate the damper 64 of the combustion air inlet 64 of the furnace 20. The damper will be actuated to open or close in accordance with the relationship shown in FIG. 5. For example for a constant sample temperature of 70° C. and a desired $CO_2$ content of 11%, the relative humidity should be 60%. However if the value of relative humidity measured in the exhaust gas is less, say 55%, then the switch and control circuit will drive the motor to close the damper and cut down the excess combustion (more than required for combustion) air entering into the combustion chamber. This results in good combustion and $CO_2$ levels rise towards the desired $CO_2$ value of 11%.

Figure 2:
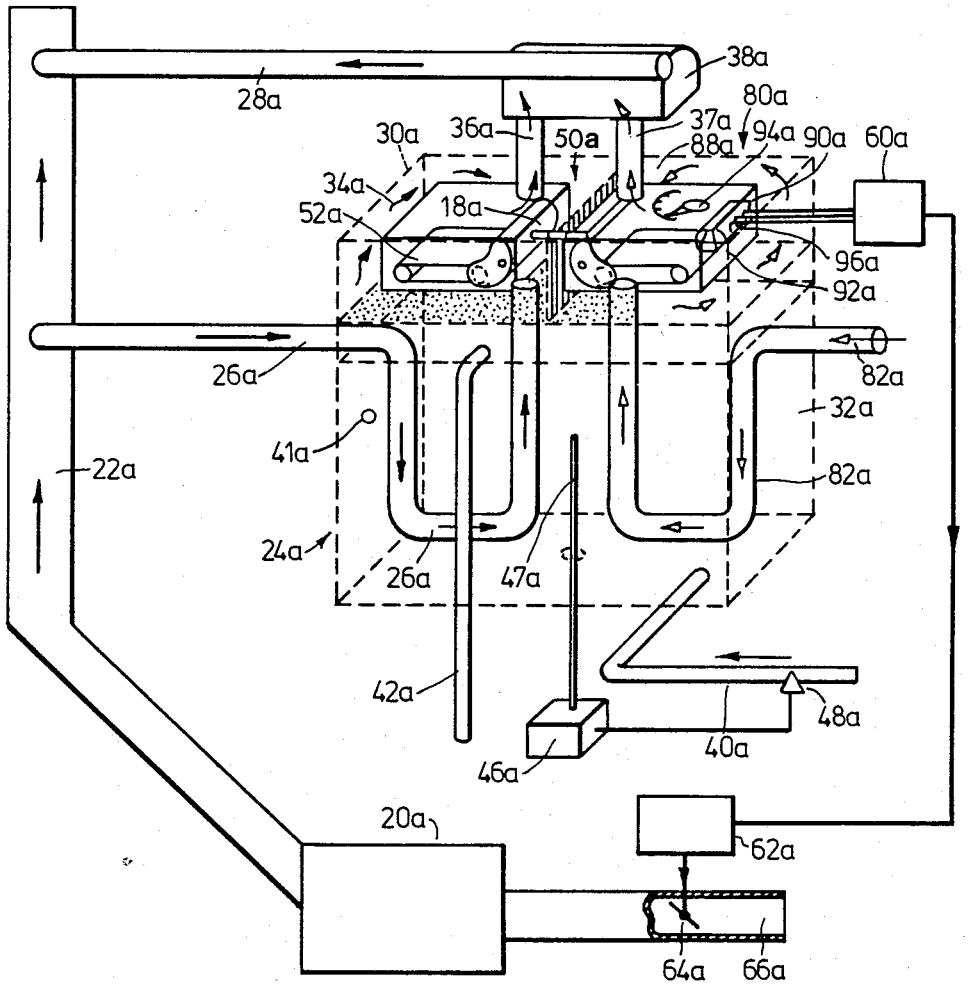
FIG. 2 is a schematic diagram of the combustion control apparatus of FIG. 1 with an additional combustion control apparatus to monitor the relative humidity of the combustion intake air.

Referring now to FIG. 2 of the drawings in which the reference numerals denote like parts as for FIG. 1, with a suffix 'a' added for clarity, an additional combustion control apparatus, generally denoted by reference numeral 80*a*, is associated with the control apparatus 24*a*. This arrangement is especially suitable for use when the relative humidity of the combustion air intake is very high. When the relative humidity of the exhaust gases is high, the water vapour present in addition to that resulting from the combustion can result in the humidity sensor 50 reading an artificially high value, and reducing the air intake prematurely resulting in incomplete combustion with increased amounts of carbon monoxide. The additional control apparatus 80*a* has an intake pipe 82*a* which receives air from the inlet manifold of the combustion air intake 66*a*. The temperature of the intake air is controlled by the apparatus 80*a* in the same way as the exhaust gas is controlled by apparatus 24*a*. The inlet pipe 26*a* from the exhaust chimney and the air inlet pipe 82*a* are maintained in the same water chamber 32*a* for ease of construction and temperature control is provided by the thermostat 46*a*, thermistor 47*a*, the valve 48*a* and cold water supply 40*a*.

Figure 4:
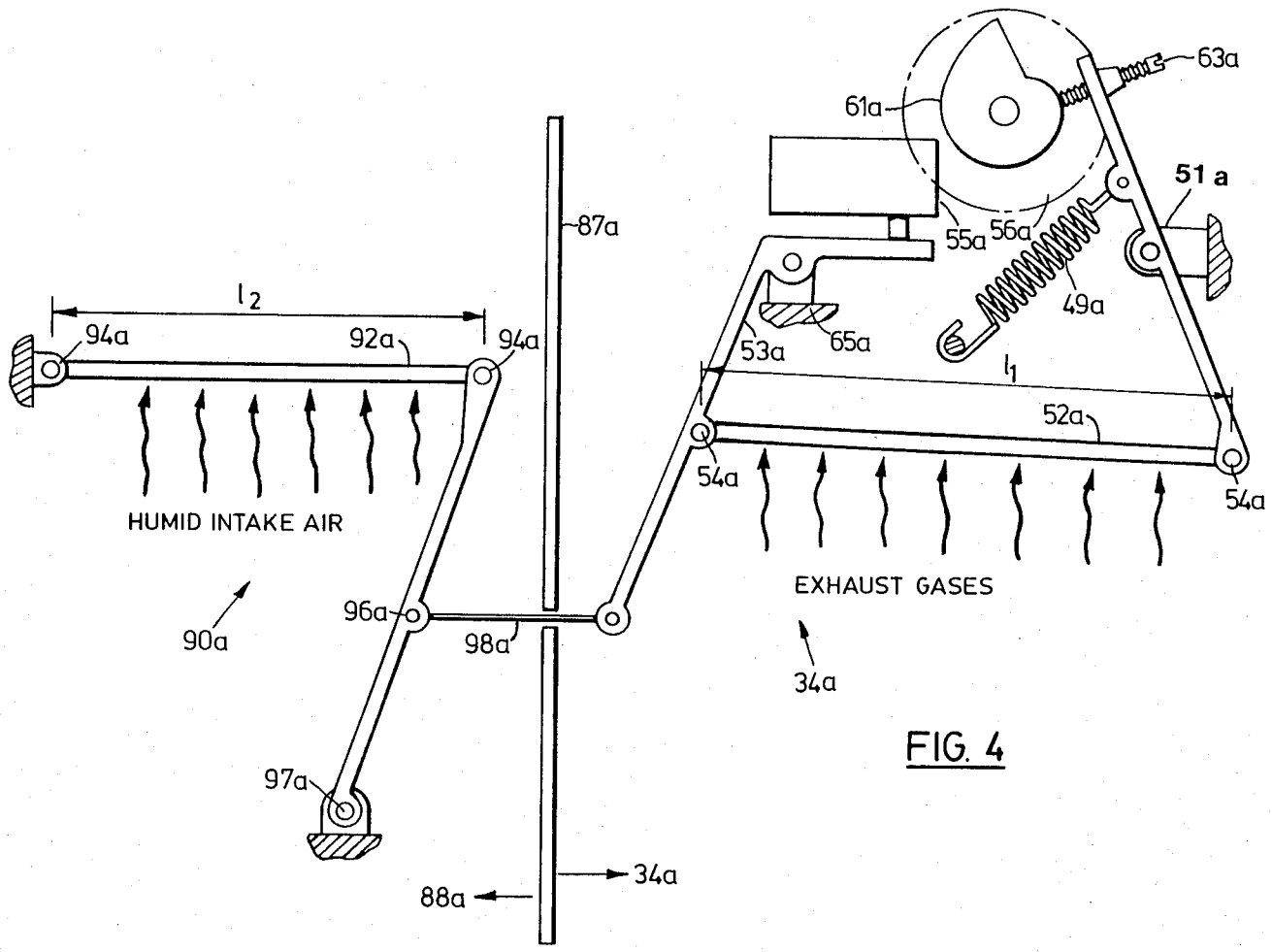
FIG. 4 is a more detailed diagram of the humidity sensor shown in FIG. 2.

To compensate for changes in humidity of the combustion air, a pair of humidity sensors 50, 90*a* are linked as shown in more detail with reference to FIG. 4. The gas chambers 34*a*, 88*a* are separated by a wall 87*a*, with the gas chamber 88*a* having a second humidity sensor 90*a*. The humidity sensor 90*a* has a diaphragm 92*a*, spaced supports 94*a*, one of which is fixed and the other of which is movable and a control arm 96*a* associated with the movable support. Humidity sensor 90*a* is connected to the humidity sensor 50*a* by a rigid rod generally denoted by reference numeral 98*a* which passes through wall 87*a*.

The exhaust gas and air intake gases are passed from chambers 34*a*, 88*a* through fan inlet tubes 36*a*, 37*a* respectively and the gases are then exhausted by a common suction fan 38*a* which passes the gas through a common conduit 28*a* to the furnace chimney 22*a*. By adjusting the dial 64*a* a specific tension is placed on the diaphragm 52*a* which is transferred by means of the rod 98*a* onto the diaphragm 92*a*. A change in the humidity of the inlet air causes a corresponding change in the humidity of the exhaust gases so that tension in the diaphragms 52*a*, 92*a* will change by equal amounts. The connection of rod 92*a* ensures that the linkage remains balanced so that the position of linkage 53*a* will not change. The pivot points are sufficiently friction free to introduce no restriction on the movement of the diaphragm 52*a*. A change in the humidity of the combustion products caused by a change in the level of $CO_2$ will only be sensed by diaphragm 52*a*. The tension in the diaphragm 52*a* differs from the tension in diaphragm 92*a* so that the linkage will be unbalanced. The arm 53*a* then moves to a position in which the tension in both diaphragms is equal and causes actuation of switch 55*a*. As the $CO_2$ content of the combustion products changes, and hence the water vapour content, the tension in diaphragm 52*a* changes and the link moves back to maintain the contact 58*a* between contacts 57*a*, 59*a*.

A change in the relative humidity in combustion intake air will, therefore, affect both diaphragms but will be cancelled by the effect of the linkage so that the humidity sensor 50*a* is sensitive to only the water vapour in the combustion products, which is indicative of the $CO_2$ content in the combustion products.

Without departing from the scope of the invention it should be appreciated that various modifications may be made to the embodiments described herein, for example, any type of thermostat and humidity sensor can be used. In addition, as shown in dotted outline in FIG. 1 the input signal from the hygrometers can be used to control a damper 45 on the chimney by control unit 43 to regulate the combustion. Although the preferred embodiment discloses natural gas as the fuel, it is considered that the other suitable fuels having gaseous combustion products may be used. Furthermore, depending on the type of furnace used the primary air or secondary air can be regulated. The induced pressure need not be negative, a positive pressure could also be used to blow the gases through the conduits.

For a given relative humidity at a particular constant temperature the combustion of carbon dioxide can be kept substantially constant optimising combustion of the natural gas. This is achieved by connecting the output of the humidity sensor to the combustion damper in the air inlet of the furnace.

Advantages of the preferred embodiment of the present invention are that the control apparatus used is inexpensive and is able to be cheaply produced, no modification of existing furnaces is required and the unit can be provided simply as an "add-on" device; the saving in fuel is such that the expenditure for a combustion control package is justified. The adjustability of the humidity sensor ensures the apparatus can be adjusted to optimise combustion of natural gases with varying amounts of constituent gases.

I claim:

1. Apparatus for controlling the combustion of a fuel in an appliance comprising:

means for receiving the exhaust gases of the appliance, means for maintaining the exhaust gases at a substantially constant temperature between the steam point and the dew point of the gases, humidity sensor means for monitoring the relative humidity of the substantially constant temperature exhaust gases and for producing an output signal upon the relative humidity deviating from a predetermined level, and control means for using said output signal to control the combustion of fuel in the appliance to maintain the humidity at said predetermined level.

2. Apparatus as claimed in claim 1 wherein the control means is connectable to a regulator in the combustion air intake, said regulator being movable to regulate the intake of combustion air to the combustion chamber of the appliance in response to signals from the control means.

3. Apparatus as claimed in claim 1 wherein the control means is connectable to a regulator in the exhaust of the appliance, said regulator being movable to regulate the passage of combustion air to the combustion chamber of the appliance in response to signals from the control means.

4. Apparatus as claimed in claim 1 wherein the fuel is natural gas and the appliance is a natural gas-fired appliance.

5. Apparatus as claimed in claim 4 wherein the appliance is a furnace, the furnace having a chimney for venting the exhaust gases, and the apparatus having means directing the substantially constant temperature exhaust gases back to the chimney.

6. Apparatus as claimed in claim 2 wherein the means for maintaining the exhaust gases at a substantially constant temperature is a temperature regulated water tank, a conduit for transferring the exhaust gases through said water tank and a temperature controller to maintain the temperature of the water in the tank at substantially constant temperature.

7. Apparatus as claimed in claim 6 wherein a chamber is associated with the water tank, said chamber receiving the substantially constant temperature exhaust gases and having said humidity sensor means therein.

8. Apparatus as claimed in claim 7 wherein the chamber is connected by a conduit to the chimney, said conduit having a fan means associated therewith for providing a constant pressure to intake said exhaust gases from the chimney, through the water tank into said chamber and to return said constant temperature exhaust gases from the chamber to the chimney.

9. Apparatus as claimed in claim 8 wherein the humidity sensor means includes a diaphragm, the diaphragm being supported at spaced locations responsive to changes in relative humidity to cause relative movement between said locations, and switch means responsive to said relative movement to produce an electrical output signal upon movement of said locations from a predetermined arrangement.

10. Apparatus as claimed in claim 9 wherein the relative humidity sensor is adjustable to vary said predetermined value.

11. Apparatus as claimed in claim 10 wherein the electrical output from the switch means is processed by the control means to control movement of the regulator.

12. Apparatus as claimed in claim 6 wherein the temperature of the water is regulated by a thermostat, the thermostat having an output connected to valve means to control flow of a cooling water to said water tank, said valve being opened to permit the flow of cooling water to the tank when the water temperature exceeds a predetermined value.

13. Apparatus as claimed in claim 1 wherein the apparatus includes a second chamber associated with the water tank and isolated from the first chamber, the second chamber including second humidity sensor means, the second chamber receiving a proportion of gas taken from the air intake, the proportion of gas being passed through said water bath to maintain the same substantially constant temperature as the exhaust gas, the first and the second humidity sensor being connected by linkage means, said linkage means being arranged to actuate said control means in response to a change in the relative humidity of the exhaust gases due to a change in the combustion products of the exhaust gas.

14. Apparatus as claimed in claim 13 wherein the humidity sensors are adjustable to set the relative humidity of the exhaust gas at a predetermined value and control combustion of the intake air.

15. A method of controlling the combustion of a fuel in an appliance comprising the steps of sampling the combustion exhaust gases from the appliance maintaining the temperature of the exhaust gases at a substantially constant value between the steam point and the dew point, monitoring the relative humidity of said substantially constant temperature gas, providing an output signal upon the monitored relative humidity deviating from a predetermined value, and using said output signal to control the combustion of fuel to return the humidity of said exhaust gases to the predetermined level.

16. A method as claimed in claim 15 including sampling the air intake, controlling the temperature of the sampled air to be at said substantially constant temperature, monitoring the relative humidity of the sampled substantially constant temperature air, comparing the relative humidity of the two samples providing an output signal upon relative humidity of the exhaust gases changing without a corresponding change in the humidity intake of the air, and using said output signal to control the combustion of fuel.

17. A method as claimed in claim 15 including using natural gas as the fuel.

18. A method as claimed in claim 16 including using natural gas as the fuel.

19. A method as claimed in claim 15 including the step of adjusting the humidity sensors to said predetermined value.

20. Apparatus for controlling the combustion of a heating appliance having gaseous combustion products comprising a passage to receive a sample of the exhaust gas of the appliance, heat exchange means associated with said passage to maintain said sample at a predetermined constant temperature between the dew point and the steam point of said gas, humidity sensing means in said passage downstream of said heat exchange means responsive to variations in the humidity of said gas to provide a control signal upon deviation of said humidity from a predetermined value, said control signal being operable upon said appliance to adjust the combustion thereof to maintain said humidity at said predetermined level.

21. Apparatus for determining variations in the combustion products of a heating applicance intake air comprising a first humidity sensor adapted to receive combustion exhaust gases, a second humidity sensor adapted to receive intake air, the first and second humidity sensors being separated from contact with the intake air and the exhaust gases respectively, linkage means connected between the first and second sensors to compare changes in the humidity detected by said first and second sensors, said apparatus means producing an output signal upon a change in humidity detected by said first sensor only.

* * * * *